United States Patent [19]

Meier et al.

[11] 4,003,146

[45] Jan. 18, 1977

[54] METHOD OF MANUFACTURE OF A SHOE

[76] Inventors: Ernst Meier, Schutzengasse 22, CH-8001 Zurich; Alois Odermatt, Barzstrasse 2, CH-8437 Zurzach, both of Switzerland

[22] Filed: Feb. 13, 1975

[21] Appl. No.: 549,580

[30] Foreign Application Priority Data

May 31, 1974 Switzerland ..... 7487/74
Dec. 11, 1974 Switzerland ..... 16447/74

[52] U.S. Cl. ..... 36/44
[51] Int. Cl.[2] ..... A43B 13/18
[58] Field of Search ..... 36/43, 44, 69, 30 R, 36/11.5

[56] References Cited

UNITED STATES PATENTS

| | | | |
|---|---|---|---|
| 1,516,305 | 11/1924 | Price et al. | 36/43 |
| 3,091,042 | 5/1963 | Gilkerson | 36/43 |
| 3,333,353 | 8/1967 | Garcia | 36/69 |

*Primary Examiner*—Patrick D. Lawson
*Attorney, Agent, or Firm*—Pollock, Vande Sande & Priddy

[57] ABSTRACT

The invention facilitates manufacture of a shoe in which the foot has a correct vertical position, and has a better attitude then in known shoes, by anatomically correct development of the tread over the big toe and prevention of tilting over the outer edge.

An inner bottom which is intended to be fitted on a last and connected with a shank and outsole, is provided with (i) an under surface which is approximately flat between the tips and the balls of the toes in the region of the front of the foot and also in the region of the heel, (ii) an upper surface which is practically flat in the region of the toes, and has depressions in the regions of the ball of the big toe and of the small toe, of which the first reaches downwards at least into the plane of the toe region, while the other is less pronounced.

9 Claims, 37 Drawing Figures

2
9
10
11
3
4
5
6
8
7

32
39
41
40
37

33
h
34
41
38
40
32

38
40
41

38
40
41 r 35
38
40
41

38
32
31
39
37
33
40
41
36
α
t
41
38

31
37
40
32
36 d
t
5
6
35
4
38
40
41
32
2
39
3
31
37

41
38
32
31
39
34
41
40
37

23
22
21

20
19

32
39
34
38
40
37

18
17
b
16
15
14
19
20
21
22

23

Fig.18
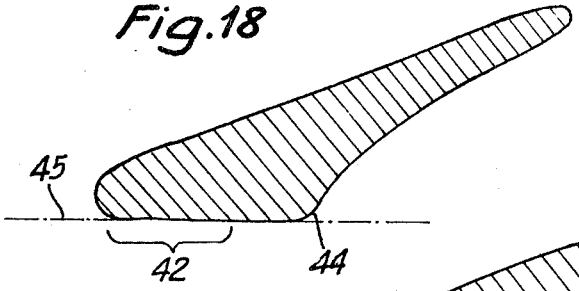
Fig.17
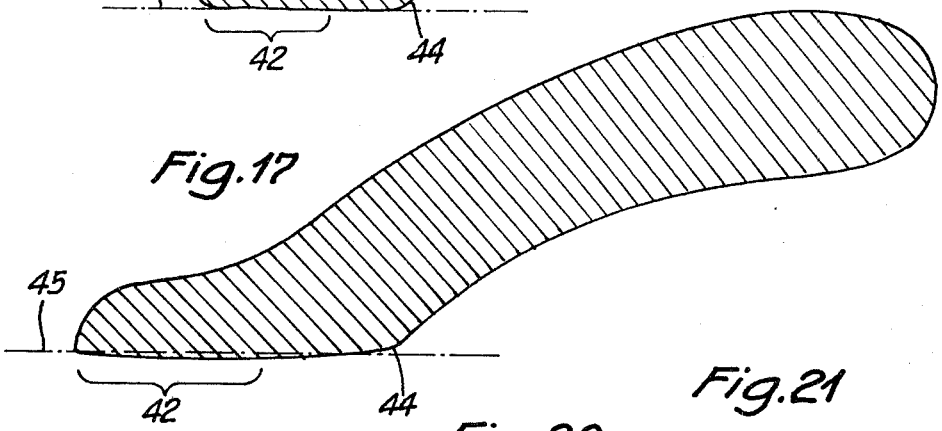
Fig.21
Fig.20
Fig.19
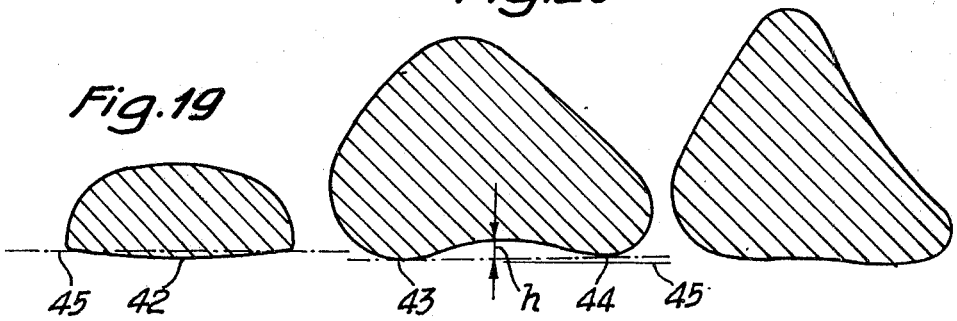
Fig.22
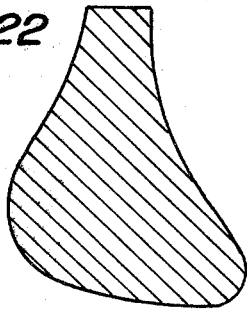
Fig.23
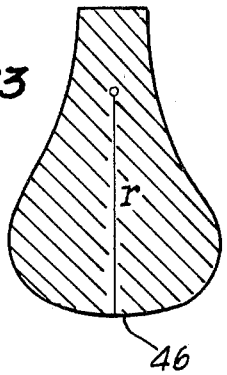

47
50
33
35
V
VI
VII
VIII
IX
34

51
51
33

39
35
50
47
49
41

50

39
47
49

51
50

49
39
47

50

39
47
49

51
50
34

39
47
49

35
51
47
41
49

39
49

33
39
47
49

50
47
41

51
51
47
50

51
47
50

51
47
50
41

I
II
III
IV
V
VI
VII
47

METHOD OF MANUFACTURE OF A SHOE

The internal shape of shoes in use today, especially of the bottom stock, is unsatisfactory, and very often leads to deformation of the feet, because the foot is in a false, unnatural position in the shoe, in which it is undesirably strained and/or tilted to one side. Besides, in shoes with relatively high heels, the foot slides forwardly and the front of the foot is overstrained. Also, deformation of the toes can finally occur, particularly of the big toe (hallux vulgus), or spreading of the ball of the foot.

The reason for these occurrences results to an important extent because the inside of the bottom in known shoes, in the region of the front of the foot, as made on the factory last which is usual up to the present, is cambered downwards, and thus opens out downwards in the line of the toe joint, in the place of a transverse arch, by which the formation of foot spread is readily caused. In the region of the heel the inside of the bottom is practically flat, so that the heel, cushion of the foot moves laterally, the heel bone makes hard impact during each step, with shock to the spinal column, and in addition loses any protection of the vertical attitude of the foot in the ankle, by which serious bending in the ankle joint is caused, with stretching of the ligaments in the tarsus. The lack of longitudinal arching, especially at the inner edge, encourages fallen arches of the foot.

The object of the invention is to remedy these deficiencies and to facilitate manufacture of a shoe in which, on the one hand, the foot has a correct vertical position, and on the other has a better attitude than in known shoes, by anatomically correct development of the tread over the big toe and prevention of tilting over the outer edge.

It has previously been proposed to incorporate additional so-called arch supports in shoes, to give the foot a correct attitude. The result was limited, and besides the manufacture of such shoes was unduly complicated, extravagant of labour, thus expensive.

The object of the invention is to provide an inner bottom for a shoe which is intended to be fitted on a last and connected with a shank and outsole. The inner bottom, has an under surface which is approximately flat between the tips and the balls of the toes in the region of the front of the foot. In the region of the heel it has an upper surface which is practically flat in the region of the toes but has depressions in the regions of the ball of the big toe and of the small toe, of which the first reaches downwards at least into the plane of the toe region, while the other is less pronounced. The shoe component is made concave in the region of the heel, with a maximum radius of curvature of 1.5 times the greatest width of the shoe component: The upper surface in the heel region has a flat tangential plane which forms an angle of 10° maximum with the plane of the toe region. A filling material is placed between the underside surface and the upper side surface of the shoe component. More specifically, there is provided in the region of the front of the foot a first soft, flexible filling material, and behind it, in the mid-foot region and in the heel region, a second harder filling material. In the manufacture of a shoe using the shoe component of this invention, a last is used whose underside is shaped the same as the surface of the upper side of the shoe component.

The shoe component, on the one hand, can be manufactured relatively simply and cheaply, as explained below, for example from plastic by moulding or extruding. On the other hand, the shoe component is employed in a manner similar to a usual inner bottom in the manufacture of a shoe, practically without additional expense.

Preferably the upper side surface of the shoe component and the underside of the last can be somewhat sloped upwards towards the front and in front of the tangential plane parallel to the plane of the toe region. Thus, in the finished shoe, especially also in shoes with relatively high heels, sliding forward of the foot can be avoided. Also, the depressions for the ball of the big and small toes can still further contribute to this, and they can help through this to avoid the formation of fallen arches.

By means of the spherical rounding of the upper surface of the shoe component (and of the underside of the last) in the region of the heel, the heel of the foot can with advantage be thrust into the deepest part of the rounding, and thereby brought into a vertical attitude. In addition, the rounding can help to avoid the lateral thrust away of the heel pad under the heel bone, which in prior art shoes has the result that during walking the ankle makes hard impact with much shock.

The region of the mid-foot and the upper surface of the shoe component, also the underside of the last, can suitably have a relatively high rise, of which the highest position can preferably lie somewhat behind the front third of the distance between the lowest position of the heel and the lowest position of the ball of the big toe.

The following examples of construction of the invention are explained by means of the drawings, which show;

Figure 1:
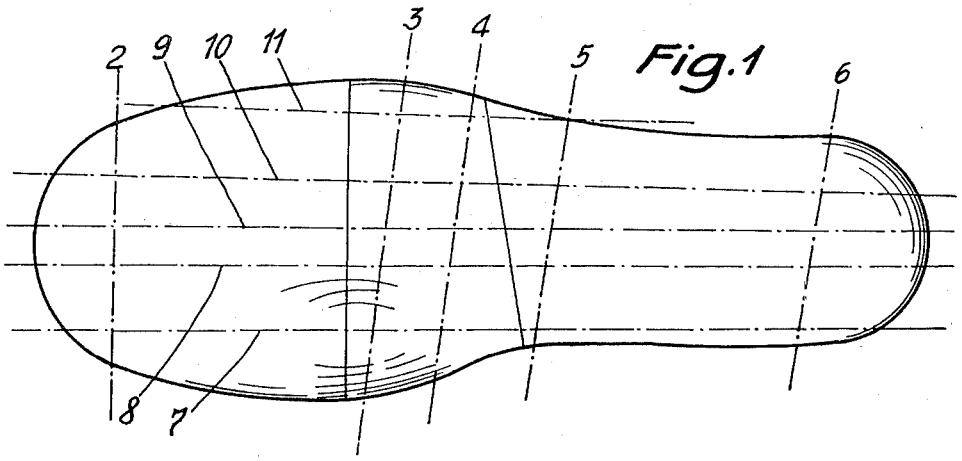
FIG. 1 is a plan of a shoe component for a lady's right shoe with a medium high heel.

FIGS. 7–11 comprise longitudinal sectional views of the shoe component of FIG. 1 taken along section lines 7, 8, 9, 10 and 11, respectively of FIG. 1.

Figure 12:
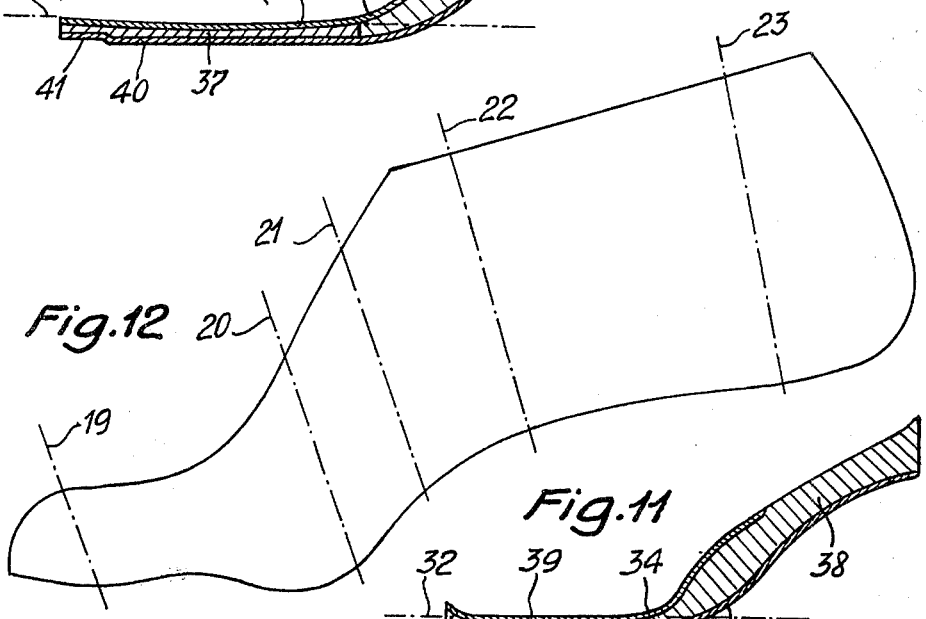

FIG. 12 is a side view of a last for a lady's right shoe with medium high heel, with which the shoe component to FIGS. 1 to 11 can be made.

Figure 13:
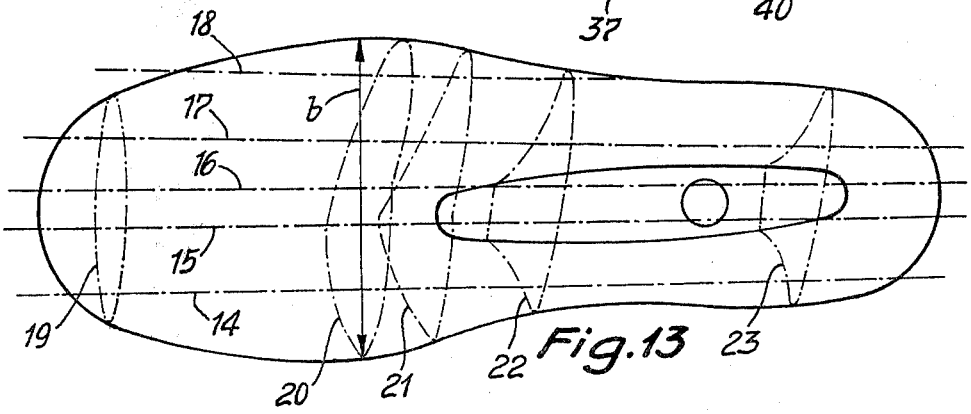
Figure 14:
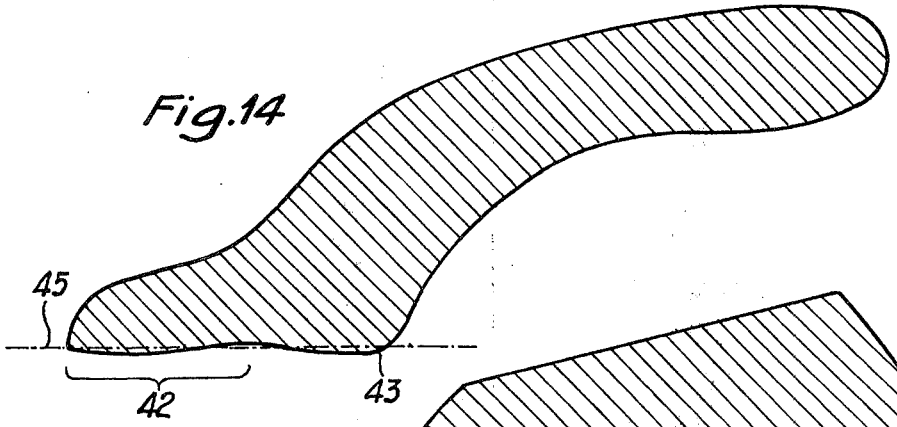
Figure 15:
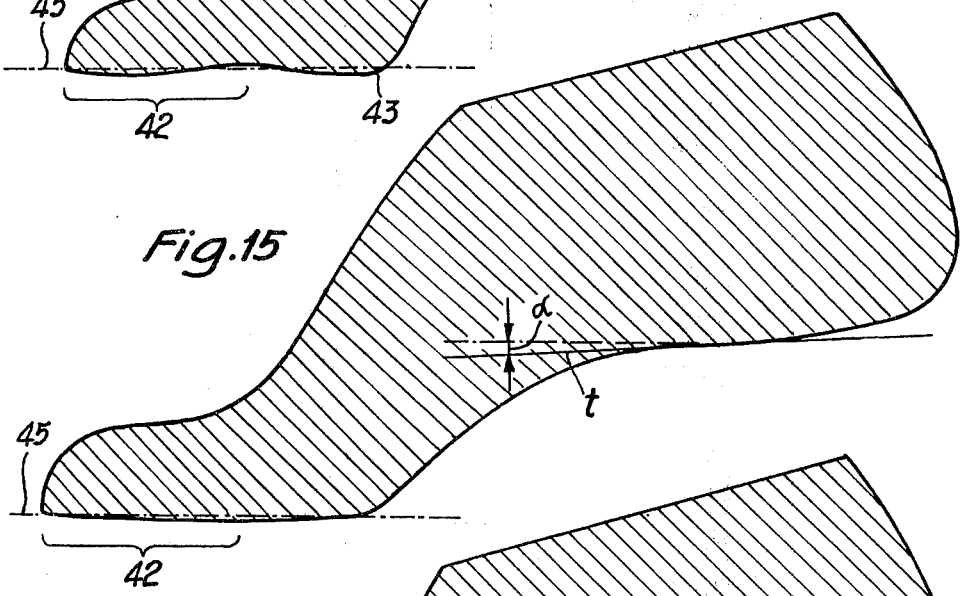
Figure 16:
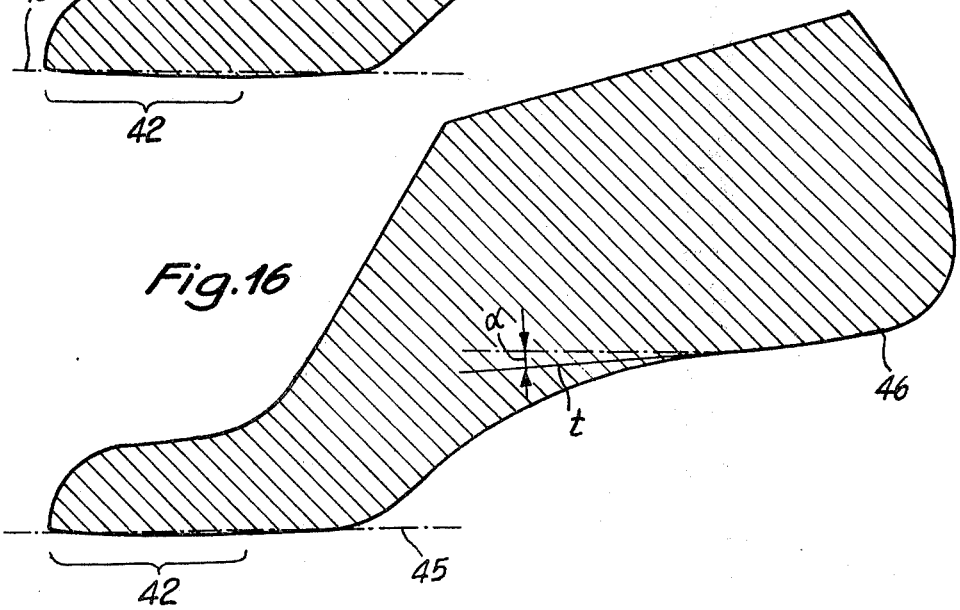

FIG. 13 is a plan of the last of FIG. 12.

FIGS. 14–18 are longitudinal sectional views taken along the section lines 14, 15, 16, 17, and 18 in FIG. 13.

FIGS. 19–23 are cross-sectional views taken along the section lines 19, 20, 21, 22, and 23 in FIGS. 12 and 13.

Figure 24:
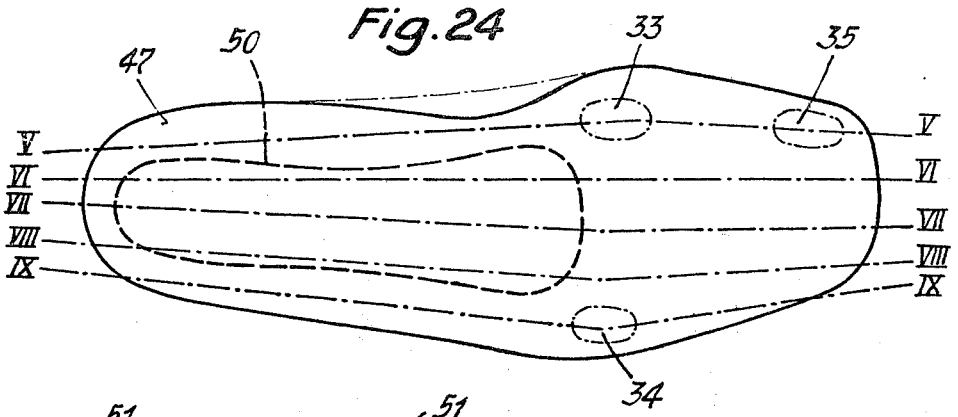

FIG. 24 is a plan view of a second form of construction of the shoe component of the invention.

FIGS. 25–29 comprise longitudinal sectional views taken along the lines V, VI, VII, VIII and IX in FIG. 24.

Figure 25:
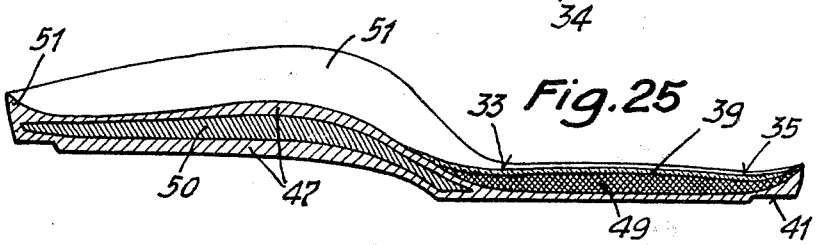
Figure 26:
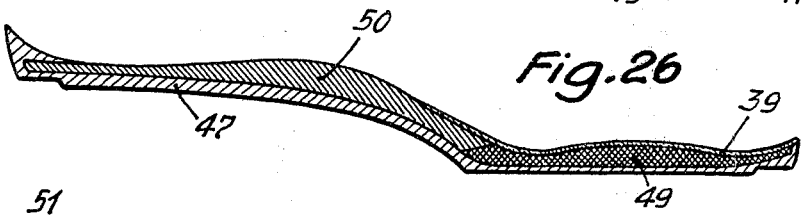
Figure 27:
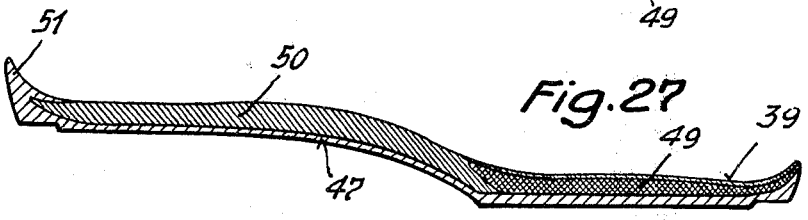
Figure 28:
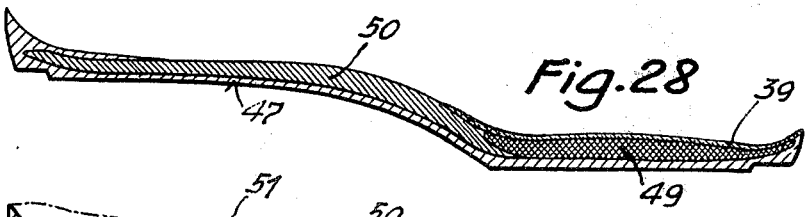
Figure 29:
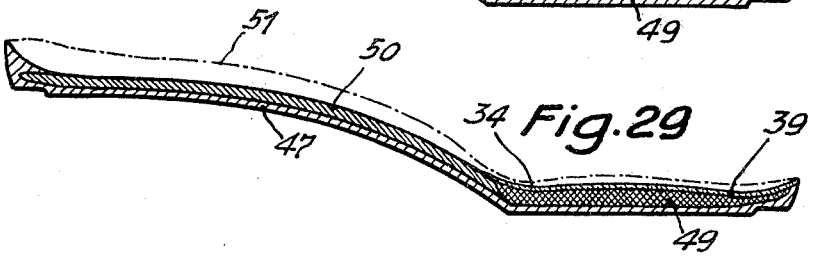
Figures 30, 31, 32, 33, 34, 35, 36, 37:
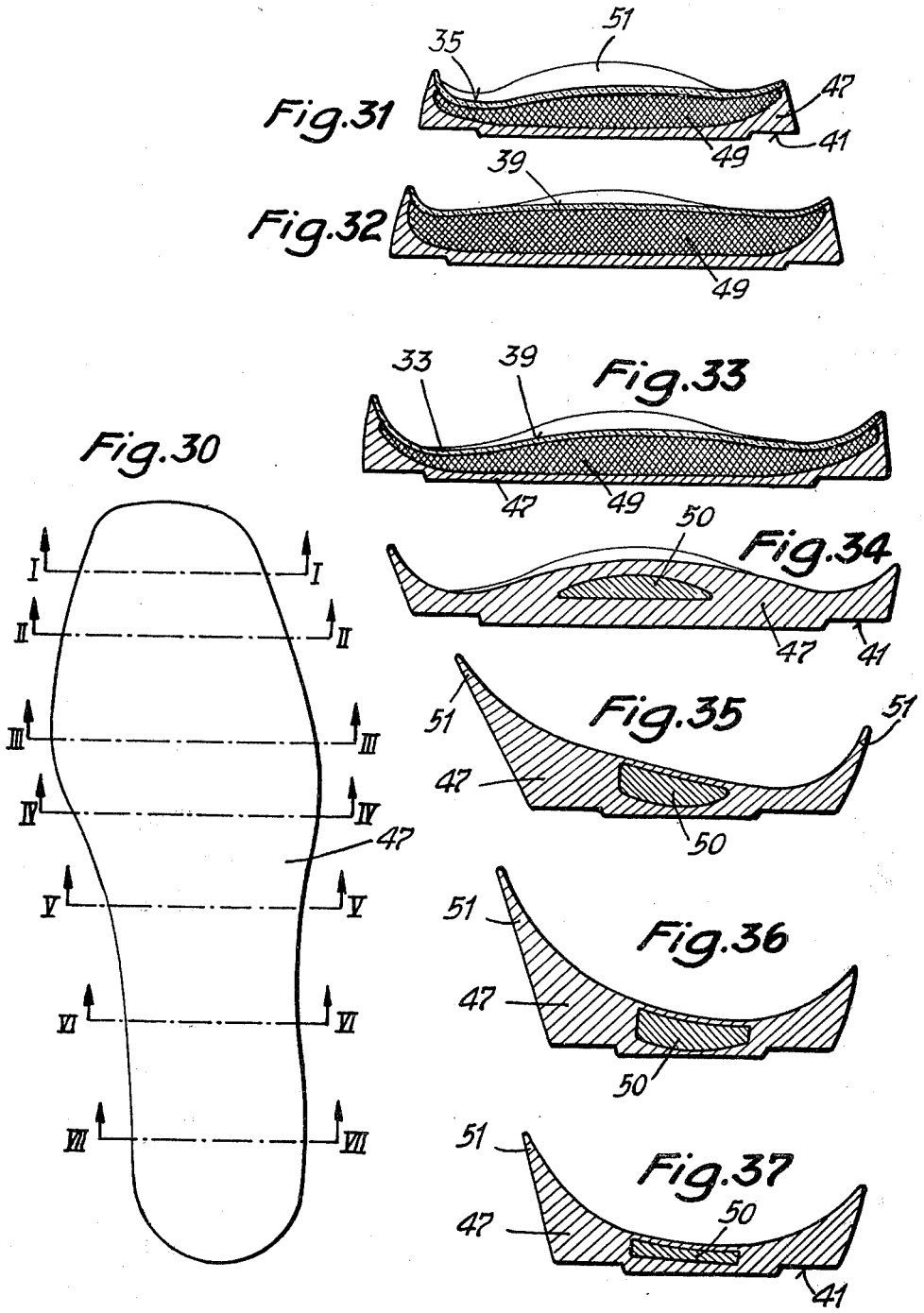

FIG. 30 is a plan view of the shoe component of FIG. 25.

FIGS. 31–37 comprise cross-sectional views taken along the section lines I, II, III, IV, V, VI and VII in FIG. 30.

Figure 2:
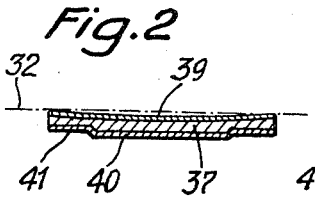
FIGS. 2–6 are cross-sectional views of the shoe component of FIG. 1 and also FIG. 9 taken on the section lines 2, 3, 4, 5, or 6, respectively.

The upper side surface of the shoe component shown in FIGS. 1 to 11 is practically flat in the toe region 31 as shown in FIG. 2. The plane of the toe region is indicated by 32.

Figure 3:
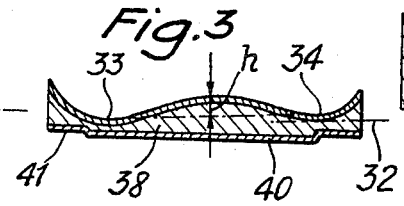
Figure 4:
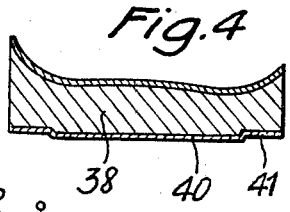
Figure 5:
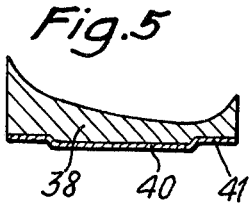
Figure 6:
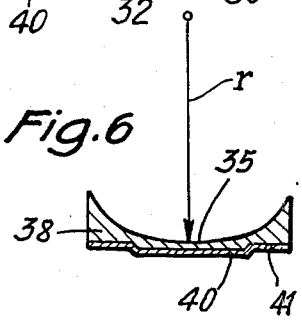
Figure 7:
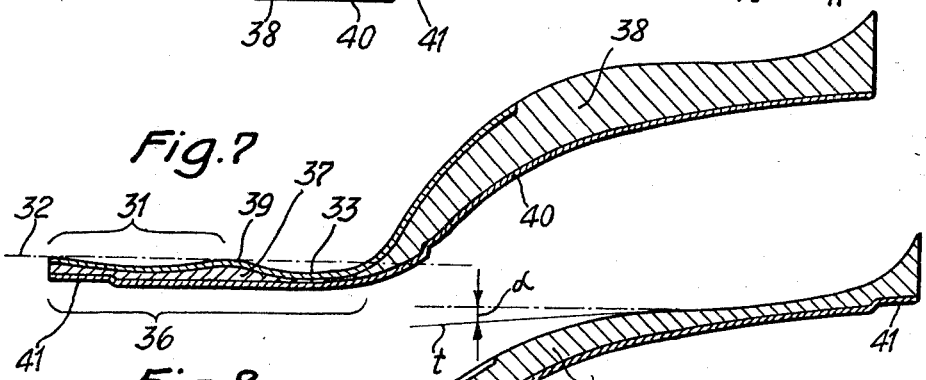
Figure 8:
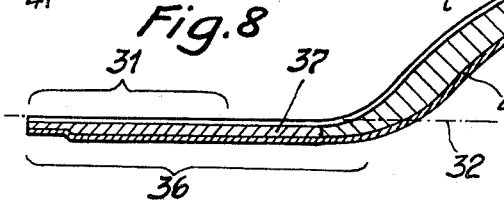
Figure 9:
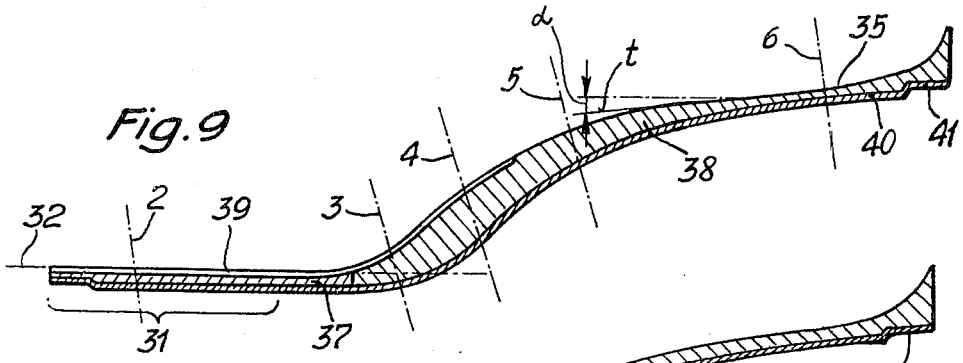

Behind the toe region, in the region of the ball of the toes, there is a depression in the upper surface, shown in FIG. 3 at 33 for the big toe and at 34 for the small toe. The depression 33 for the big toe extends downwards at least into the plane of the toe region. This depression can also project downwards below the toe region plane 32, for example, according to the size of shoe, by about 3 to 8 mm. The small toe depression 34 is less pronounced than depression 33. For example, it preferably projects downwards about 2 to 6 mm less far than the depression 33; however, it can also extend into the toe region plane 32, or even somewhat beyond. Between the depressions 33 and 34, the upper surface projects upwards to a height *h* (FIG. 3), as measured from the line connecting the tops of the two depressions 33 and 34, which height *h* is at least 0.025 of the greatest width *b* (FIG. 1) of the shoe component, preferably about $0.05 \times b$. The height *h* can be about 3 to 5 mm or more. In the finished shoe, this increase in height of the upper surface supports the foot under the capitulum of the mid-foot bones and the toe joints.

When the different lowest points of the inner bottom are taken into account, the foot takes up a safe vertical position in definite form, and assumes with it the anatomically correct function and development of stride from the heel straight over the big toe.

Figure 10:
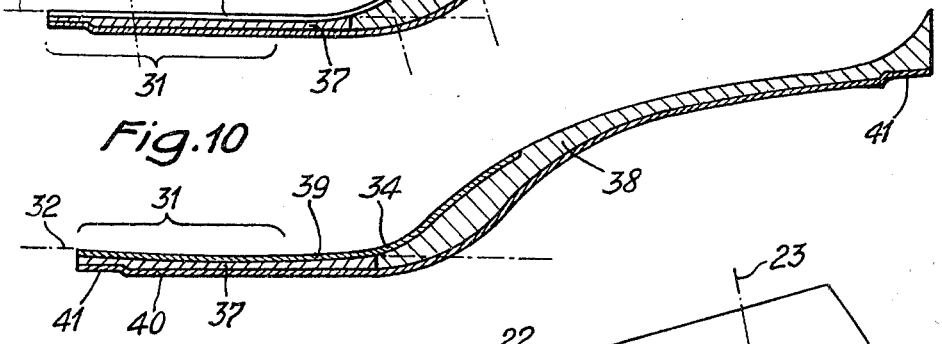
Figure 11:
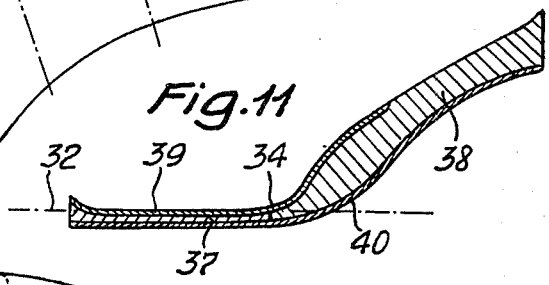

In the region of the mid-foot, between the front of the foot and the heel, the upper cross-sectional surface is markedly cambered upwards, with a greater amount of camber being provided at the inside (FIG. 7) than the outside of the foot (FIGS. 10, 11). Preferably highest position, in relation to the distance between the tops of depressions 33 for the ball of the big toe and 35 for the heel, is somewhat behind the front third of this distance, i.e. at approximately at section plane 5.

In the region of the heel, the upper surface is made spherically concave, with a radius of curvature *r* (FIG. 6) in cross-section, which is a maximum of 1.5 times the greatest width *b* of the shoe component, preferably equal to the width *b* maximum, and as illustrated, suitably about $0.7 \times b$. In the case of average sizes of shoe, the radius of curvature *r* can be usefully less than 10 mm. The spherical deepening in finished shoes gives the heel a safe attitude, especially laterally, and guarantees the vertical position of the heel bone and thus of the ankle joints. Furthermore, displacement of the pad which is under the heel laterally into the edge of the shoe is prevented.

In order to avoid as much as possible a forward movement of the foot in the shoe, also in the case of heels which are not quite flat, the upper surface is inclined only very little forwards and downwards in the front part of the heel region, and has a flat tangential plane *t* (FIGS. 8 and 9), which is preferably inclined not more than 5°, or at the most 10°, to the horizontal, i.e. to a plane parallel to the plane of the toe region. The upper surface could also be horizontal in the front part of the heel region, or even inclined backwards and downwards, i.e. the upper surface in the heel region could form a tangential plane parallel to the plane 32 of the toe region.

The underside surface of the shoe component is practically flat in the front foot region 36 between the tips and the balls of the toes, as well as in the heel region, when the under surface is approximately parallel in the front foot region to the plane 32 of the toe region of the upper surface.

The shoe component, as already indicated at the beginning, is incorporated in a shoe similarly to a usual inner bottom. The practically flat areas of the underside surface then lead to correcpondingly flat front parts of the sole, by which the shoe maintains a safe condition in an exactly determined position, and to a flat heel surface, which facilitates good, accurate vertical fixing of the heel.

The shoe component between the upper and under surfaces consists extensively of filling material, i.e., in the front of the foot region 36, of a piece 37 of relatively soft material, which affords small resistance to bending of the front section of the shoe component, and behind this, in the mid-foot region and the heel region, of a piece 38 of harder material. The softer material of piece 37 can, for example, be cork and/or soft rubber, or foam and/or foam material. It is also possible to form the piece 37 of soft rubber and to provide therein a space opening upwards for receiving a cushion formed of a plastic-impregnated textile material (not shown), which material can have high permanent elasticity and can at the same time be capable of breathing and be absorbent of moisture and perspiration. The harder filling material of piece 38 can particularly be of plastic, for instance polyurethane. A shank piece of normal type (not shown) may be incorporated in piece 38, for example made of metal, wood or fibre. Instead of this, a square hard rubber bar (not shown) can be arranged in an opening in piece 38 or moulded into it.

The upper side at least of piece 37, can, as shown, be covered with a top layer 39 formed of leather or artificial leather. The top layer could extend over the entire upper side of the shoe component. However, as a rule it is superfluous, because during shoe manufacture a leather covering patch is in any case fitted on the rear part of the upper side.

The underside also of both pieces 37 and 38 of filling material can, as shown, have a lower covering piece 40. This can, for example, be of leather, plastic, fabric, or similar.

The shoe component can be particularly simple to manufacture in plastic by moulding or extruding, the latter especially. A mould can be used for this, in which the base corresponds to the form of the upside-down upper surface of the shoe component. The upper covering piece 39 can first be laid in the mould, when the shoe component has one. Next, a shank piece or the hard rubber bar as described can be arranged in the mould. The plastic material can then be extruded into the mould, especially a softer plastic, such as foam, in the frontal region 36, for forming piece 37, and a harder plastic (which also includes the shank piece) in the mid-foot and heel regions for forming piece 38. The underside of the plastic pieces while still positioned upside-down, can be smoothed or pressed flat and, if necessary, the covering piece 40 can be pressed on and the plastic allowed to harden.

With the shoe component as described and illustrated in the drawings, a cemented shoe can be manufactured, where the shank and the outsole are joined by cementing to the component. For the manufacture of welt-sewn or double-sewn shoes, naturally component parts can be provided also, which, similarly to the usual insole, have on the underside near the edge, a suitable lip for receiving the seam. Such a lip can be fastened on the underside of an otherwise finished part by adhesive, if necessary with aid of a joint strip. The shoe component has a recess 41 at the edge of its underside to take the edge of the shank during cementing, or the lip for cementing.

The shoe component can be marketed as described and illustrated. The shoe manufacturer can then make a shoe with it in accordance with the usual shoe manufacturing methods. If desired, the shoe component can also have a heel cap (contrefort) attached to it, for example by cementing.

Manufacture is on a last, the underside of which is the same shape as the upper surface of the shoe component. Such a last is illustrated in FIGS. 12 to 23.

The underside of the last as illustrated has a practically flat toe region 42. Behind this, in the region of the ball of the toe, there is a projection 43 for the big toe, (FIG. 14) and another 44 for the small toe, (FIG. 18) of which the big toe projection is extended downwards at least into the plane 45 of the toe region. The big toe projection 43 can also project downwards beyond plane 45, for example, according to the size of the last, by about 3 to 8 mm. The small toe projection 44 is less pronounced than projection 43. For example, it projects about 2 to 6 mm less far down, however it may also extend into plane 45 or even somewhat beyond it. The underside of the last, as measured between projections 43 and 44, is recessed upwards to a height $h$ (FIG. 20) from the line joining the projections 43 and 44, which height is at least 0.025 of the greatest width $b$ of the last (FIG. 13), preferably about $0.05 \times b$. Height $h$ can amount to about 3 to 5 mm or more.

In the mid-foot region, between the front of the foot and the heel, the underside of the last is cambered upwards, inside (FIG. 14) more than outside, and with the highest position, in relation to the distance between the top of the big toe projection 43 and the top of the heel projection 46, being somewhat behind the front third of this distance, and thus approximately on section plane 22.

In the region of the heel, the underside of the last is spherically rounded, with a radius of curvature $r$ in cross-section (FIG. 23) which is a maximum of 1.5 times the greatest width $b$ of the last, preferably the same as the width of the last as a maximum, and suitably as illustrated, $0.7 \times b$. With average sizes of last, the radius $r$ of curvature may appropriately be less than 10 mm.

The underside of the last is only very slightly inclined towards the front and downwards in the front portion of the heel region, and has its flattest tangential plane $t$ (FIG. 15 and 16), which makes an angle $\alpha$ of 10° maximum, preferably as illustrated not more than 5°, with the horizontal, i.e. with a plane parallel to the plane 45 of the toe region. The underside of the last could also be horizontal in the front portion of the heel region or even inclined to the rear and downwards, i.e. the underside could be on a tangential plane parallel to plane 45.

Obviously, shoe components and lasts of the type as described are manufactured for ladies', mens' and children's shoes in various sizes and widths (for example, small, normal, normal-wide, wide, extra wide and "hollow foot").

Not only the shoe components described may be produced on the last. A shoe can be made direct, if the intermediate space between an insole fixed to the last and an outsole is filled in a suitable manner with filling material.

Natural tread movement in the shoe, which is studied on natural principles, and which corresponds to the anatomical requirements during walking on natural soft ground, is facilitated with the shoe component of the form illustrated in FIGS. 24 to 37.

This determines the incorporation of a natural tread with the anatomically correct transverse and longitudinal arches of a healthy foot of an actual type of physique, which must be the condition for possible winning back of the lost normal position and function of the foot.

Such a shoe component, as shown in FIGS. 24 to 37, has a tread sole portion 47, consisting of tough, elastic, stable material, such as rubber or plastic, which conforms to the basic shape of the shoe component and forms with the insole 39 a unit. The tread portion 47 has on its underside a step running along the circumferential edge, for filling a shank edge or seam lip strip. The side wall type flange 51, running along the inner foot camber serves as a support extension for the foot, and is higher on the inside edge of the sole than on the outside edge. The greatest height of the support extension 51 is in the region of the joints, and diminishes towards the toes as well as towards the heel. The longitudinal middle region of the tread portion is strengthened by this flange-type support 51, and moulds more compliantly against the circumferential edge portion.

The tread portion 47 has a filling piece 49, which thickens from front to back up to the toe joint regions 33, 34. The latter is included in a hollow transverse depression 48 in the middle region of the tough elastic tread portion 47. The soft elastic filling piece 49 is embedded in the front portion of the this depression 48, while in the rear portion of the depression, a torsion stabiliser 50, formed of hard springy material, is fitted. The latter extends from the toe joint part 33, 34 to the heel seat 35. The structure of the stabiliser 50 is so chosen that a successive reduction of the elastic resistance against rotational and longitudinal forces diminishes rearwards towards the heel. Furthermore, the stabiliser 50 has changing shape in thickness and cross-section from front to rear. In addition, it has the greatest thickness in the transverse middle region, where its upper surface is symmetrical with the upper surface of the tread portion, and opens out to a flat profile in the direction towards the heel seat.

The soft elastic filling piece 49 preferably comprises thermoplastic foam material, which, through the heat of the foot, acquires a structure positively adapted to it. The deformations in the soft elastic filling piece 49 are related in the main to concave squeezing of the mid-foot bone capitulum amd the big toe.

A thermoplastic filling material can also be used for the soft elastic filling piece 49, which material has the property of hardening automatically according to positive accommodation to the foot, i.e. after once wearing the shoe.

We claim:

1. An inner bottom member for a shoe for fitting onto a last and connection with a shank and outer sole and comprising, an under surface for said member which is substantially flat both between the location of the tips and balls of the toes toward the front of the foot and also in the heel region, an upper surface for said member which defines depressions therein both for the ball of the big toe and the small toe while arching upwardly between said depressions in the lateral cross-section of said member, the depression for the small toe being shallower than that for the big toe, said upper surface of said member being of concave curvature in lateral cross section in the region of the heel with a maximum radius of curvature which is 1.5 times the greatest width of said member, said upper surface of said member having a longitudinal inclination of no more than 10° with the plane of the toe region.

2. The shoe member of claim 1 which comprises spaced upper and lower surface portions, a soft flexible filling material being disposed in the space between said upper and lower surface portions at the front of the member and a harder filling material disposed in the said space in the mid-foot and heel portions.

3. The shoe member of claim 1 in which said radius of curvature substantially equals the maximum width of said member.

4. The shoe member of claim 1 in which said radius of curvature is a maximum of 10 centimeters.

5. The shoe member of claim 1 in which said big toe depression has a depth of almost 2 to about 6 mm. greater than the depth of the small toe depression.

6. The shoe member of claim 1 in which said big toe depression extends downwardly to below the plane of the toe region of the outer surface while the small toe depression extends at least to the plane of the toe region.

7. The shoe member of claim 1 in which the upward arching between the toe depressions above the upper surfaces of the depressions amounts to at least 0.025 of the greatest width of said member.

8. The shoe member of claim 1 in which the upward arching between the toe depressions above the upper surfaces of the depressions amounts to at least 3 mm.

9. The shoe member of claim 1 in which the upper surface of said member in the heel portion lies generally in a plane parallel to the plane of the toe region.

* * * * *